US010478019B2

(12) United States Patent
Pegden et al.

(10) Patent No.: US 10,478,019 B2
(45) Date of Patent: Nov. 19, 2019

(54) SHOWER RODS

(71) Applicant: Croydex Limited, Andover Hampshire (GB)

(72) Inventors: Peter James Harold Pegden, Kingswood (GB); Jonathan Harry Tooley, Hampshire (GB)

(73) Assignee: Croydex Limited, Andover Hampshire (GB)

( * ) Notice: Subject to any disclaimer, the term of this patent is extended or adjusted under 35 U.S.C. 154(b) by 0 days.

(21) Appl. No.: 15/510,390

(22) PCT Filed: Sep. 4, 2015

(86) PCT No.: PCT/GB2015/052567
§ 371 (c)(1),
(2) Date: Mar. 10, 2017

(87) PCT Pub. No.: WO2016/038344
PCT Pub. Date: Mar. 17, 2016

(65) Prior Publication Data

US 2017/0238767 A1 Aug. 24, 2017

(30) Foreign Application Priority Data

Sep. 11, 2014 (GB) ..... 416102.0

(51) Int. Cl.

| | |
|---|---|
| ***A47K 3/38*** | (2006.01) |
| ***A47H 1/022*** | (2006.01) |
| ***A47H 1/102*** | (2006.01) |
| ***A47H 1/142*** | (2006.01) |

(52) U.S. Cl.
CPC ..... *A47K 3/38* (2013.01); *A47H 1/022* (2013.01); *A47H 1/102* (2013.01); *A47H 1/142* (2013.01)

(58) Field of Classification Search
CPC ..... A47K 3/38
USPC ..... 4/608
See application file for complete search history.

(56) References Cited

U.S. PATENT DOCUMENTS

| | | | | |
|---|---|---|---|---|
| 2,199,851 | A * | 5/1940 | Culver | A47H 1/102 211/104 |
| 9,271,592 | B2 * | 3/2016 | Didehvar | A47H 1/022 |
| 2003/0217410 | A1 | 11/2003 | Moore | |
| 2004/0178310 | A1 | 9/2004 | Marion | |
| 2007/0006377 | A1 | 1/2007 | Moore | |
| 2009/0223917 | A1 | 9/2009 | Grant et al. | |
| 2011/0031198 | A1 | 2/2011 | Trettin et al. | |
| 2012/0005823 | A1 | 1/2012 | Baines | |
| 2013/0117927 | A1 | 5/2013 | Woodruff | |
| 2013/0198949 | A1 | 8/2013 | Hai | |
| 2014/0130331 | A1 | 5/2014 | Didehvar et al. | |
| 2014/0131298 | A1 | 5/2014 | Didehvar et al. | |
| 2014/0237803 | A1 | 8/2014 | Napier et al. | |
| 2014/0259368 | A1 | 9/2014 | Parker et al. | |

FOREIGN PATENT DOCUMENTS

| | | |
|---|---|---|
| GB | 2310364 A | 8/1997 |

* cited by examiner

*Primary Examiner* — Christine J Skubinna
(74) *Attorney, Agent, or Firm* — Dinsmore & Shohl LLP

(57) ABSTRACT

The invention provides a method of mounting a shower curtain rod, and/or a shower curtain rod assembly, that includes an adhesive support to supplement the conventional mounting. The adhesive support is preferably incorporated in caps that cover the junctions between the rod and the walls between which the rod is mounted.

9 Claims, 4 Drawing Sheets

SECTION C-C

SECTION F-F

SECTION G-G

SHOWER RODS

FIELD OF THE INVENTION

This invention relates to rods that are mounted between walls in a bathroom to support a shower curtain.

BACKGROUND TO THE INVENTION

A popular form of shower rod is adjustable in length and is mounted by biasing the opposite ends outwardly and into frictional engagement with facing walls. This arrangement has the advantage that it does not require perforation, by screws or the like, of the walls. By and large this frictional engagement is satisfactory but, over time or when subjected to a lateral force, the frictional engagement can be overcome and the rod displaces out of position and may become detached.

It is an object of the invention to provide a shower rod that will go at least some way in addressing the drawbacks mentioned above; or which will at is least provide a novel and useful alternative.

SUMMARY OF THE INVENTION

Accordingly the invention provides a method of securing a shower rod between facing walls, said method being characterised by using first connections configured to engage between said shower rod and said walls, and at least one separate support configured to supplement said first connections, said separate support being secured to at least one of said walls using an adhesive.

Preferably said method comprises using supports engaged about both ends of said rod and secured to both of said walls using an adhesive.

Preferably each of said supports surrounds end parts of said rod.

Preferably said adhesive comprises double-sided adhesive tape.

In a second aspect the invention provides a method of enhancing the connection between a shower rod and a pair of facing walls between which said rod is mounted, said method comprising providing additional supports between said rod and said walls, said additional supports engaging said rod and being fixed to said walls using an adhesive.

Preferably said adhesive comprises double-sided adhesive tape.

In a third aspect the invention provides a shower rod assembly for mounting between facing wall surfaces, said assembly comprising a rod; first connections operable to mount said rod between said facing walls; and a pair of separate supports engageable with said rod to supplement said first connections, said supports having adhesive surface parts contactable with said walls.

Preferably said supports surround end parts of said rod.

Preferably said supports are incorporated in caps that cover the junctions between the rod and the walls once the assembly is mounted between said walls.

Preferably said rod is hollow and has opposed ends, said first connections comprising end brackets engageable with said opposed ends.

Preferably said end brackets are configured to frictionally engage said walls.

Preferably said end brackets are configured to retain an adhesive between the end fitting and a wall. To this end each of said end brackets may be provided with an annular groove in a surface thereof facing said wall.

Many variations in the way the invention may be performed will present themselves to those skilled in the art, upon reading the following description. The description should not be regarded as limiting but rather as an illustration, only, of one manner of performing the invention. Where appropriate any element or component should be taken as including any or all equivalents thereof whether or not specifically mentioned.

BRIEF DESCRIPTION OF THE DRAWINGS

One working embodiment of the invention will now be described with reference to the accompanying drawings in which.

DETAILED DESCRIPTION OF WORKING EMBODIMENT

Figure 1:
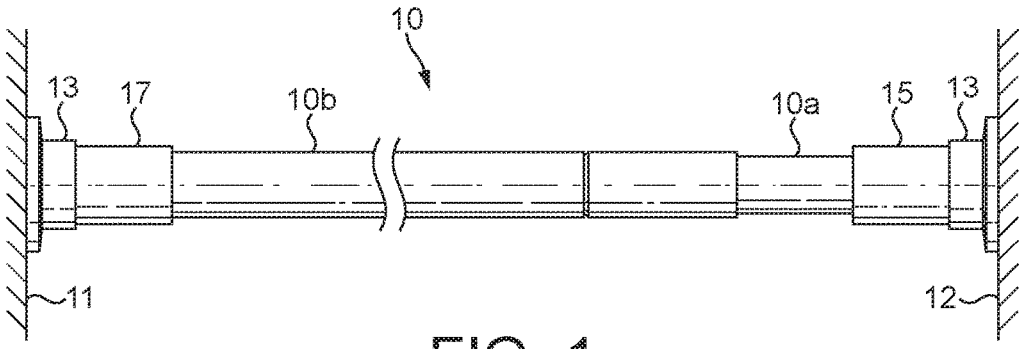
FIG. 1: shows a schematic view of a shower rod according to the invention mounted between facing walls.
Figure 2:
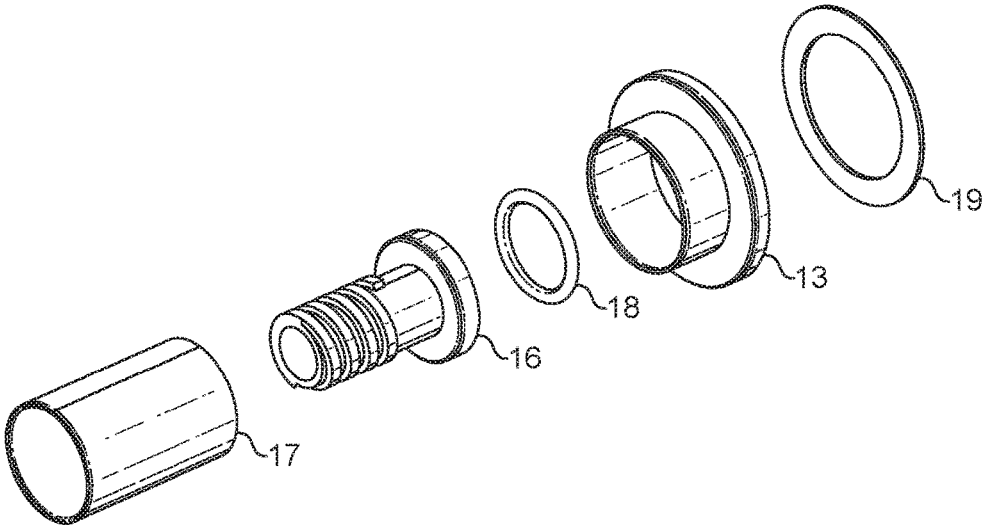
FIG. 2: shows an isometric exploded view of fixing components located at one end of the rod.
Figure 3:
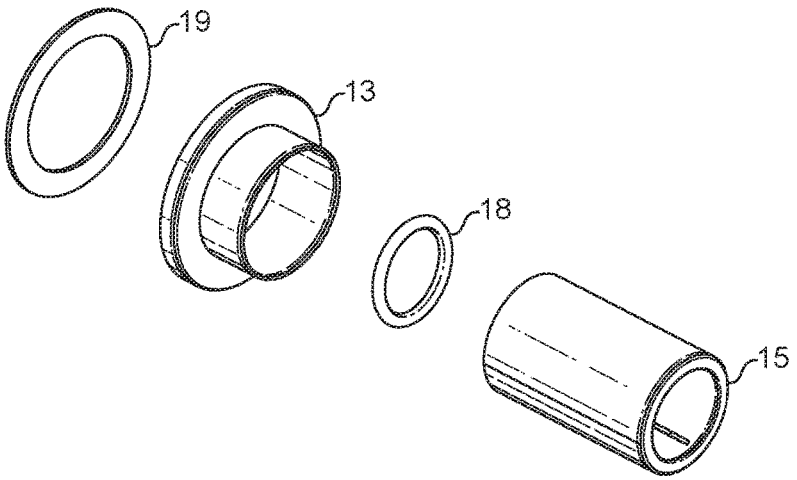
FIG. 3: shows a reverse isometric view of fixing components located at the opposite end of the rod.

Referring firstly to FIG. 1, a hollow tubular shower curtain rod 10 is shown fixed between facing walls 11 & 12. The junctions between the rod 10 and the walls is covered by caps 13 which, in accordance with the invention, have a supplementary function of also supporting the rod relative to the walls.

In the form shown the rod 10 is telescopic and comprises a section 10*a* of reduced diameter slidably retained within a section 10*b* of larger diameter.

As is well known, one primary mode of mounting the rod 10 to the walls 11 & 12 is by using first connections that generate frictional engagement between each end of the rod and its juxtaposed wall. In the embodiment depicted, this is achieved by inserting a fixed end wall bracket 15 over one end of the rod;

and inserting one end of an adjustment sleeve 17 over the opposite end of the rod. That end of the sleeve 17 not fitted over the rod has a threaded internal bore (not shown) which cooperates with adjustable end wall bracket 16. With the rod located in the desired position and the rod sections 10*a* and 10*b* locked together, in any suitable manner, so that the length of the rod is substantially the same as the distance between the walls 11 & 12, the fixed end wall bracket 15 is located against one wall while the adjustable end wall bracket 16 is screwed out of sleeve 17 and into contact with the other wall, the action of which biases both end brackets against their respective, juxtaposed walls.

This frictional engagement may be enhanced by locating resilient members 18 between the end brackets and the walls, the resilient members 18 preferably comprising rubber O-rings.

The junctions between the walls and the rod end assemblies are then covered by the caps 13 which further serve to support the ends of the rod 10 and have adhesive surfaces that engage the walls. In this way, the adhesive connections between the caps 13 and the walls 11 & 12, supplement the frictional engagement generated between the end brackets 15 and 16, and the walls and provide further resistance against lateral displacement of the rod. The adhesive surfaces are preferably provided by rings 19 of double-sided adhesive tape secured to the caps 13 in a manner that will be described in greater detail below.

The invention not only provides the adhesive connection between the caps 13 and the walls but proposes multiple connection modes between the end is brackets 15 & 16, and the walls 11 & 12, so that a user or installer may select variations of connection to achieve the desired level of support for the rod 10.

Figure 4A:
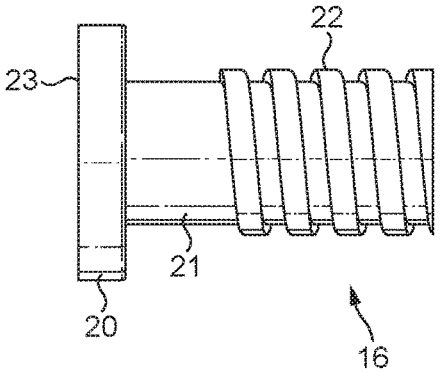
FIGS. 4A to 4C: show various views of an adjustable end wall bracket, being one of the components shown in FIG. 2.
Figure 4B:
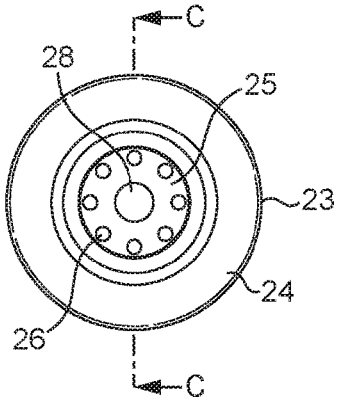
Figure 4C:
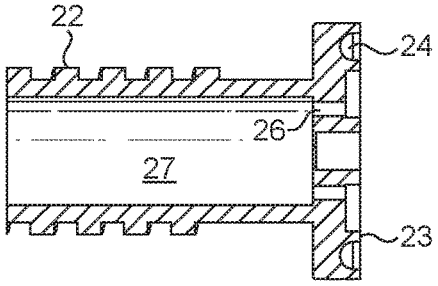

Referring now to FIGS. 4A to 4C, the adjustable end wall bracket 16 comprises end disc 20, from the front face of which projects a hollow shaft 21 that, in use, locates into an end of the adjustment sleeve 17. As described above, the other end of sleeve 17 is engaged over the free end of the larger diameter rod section 10*b*. The external surface of shaft 21 is provided with a helical thread 22 that engages a corresponding thread (not shown) within sleeve 17 to generate the bias between the rod ends and the walls. The reverse face 23 of the disc 20, being the face that engages the wall, is shown in FIG. 4B. The face 23 includes a first annulus 24 to locate and retain O-ring 18 and a second annulus 25 from which axial holes 26 project into the interior 27 of the bracket. In use, a user or installer may elect to insert an adhesive into the annulus 25 before positioning the rod and adjusting the end bracket 16. As the bracket 16 is pressed against the wall, any excess adhesive is displaced through the holes 26 and into the interior 27 of the bracket. If a permanent connection is required, and perforation of the wall is acceptable, a screw fixing may be passed through central aperture 28 in the disc 20, and screwed into the wall.

Figure 6A:
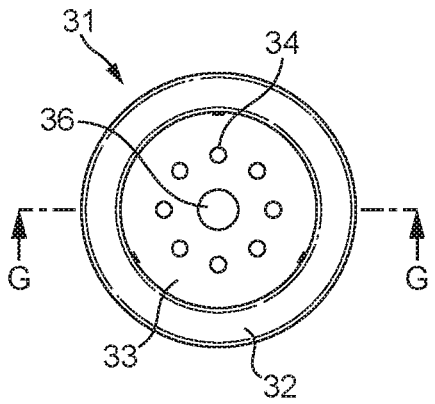
FIGS. 6A & 6B: show views of a fixed end wall bracket being one of the components shown in FIG. 3.
Figure 6B:
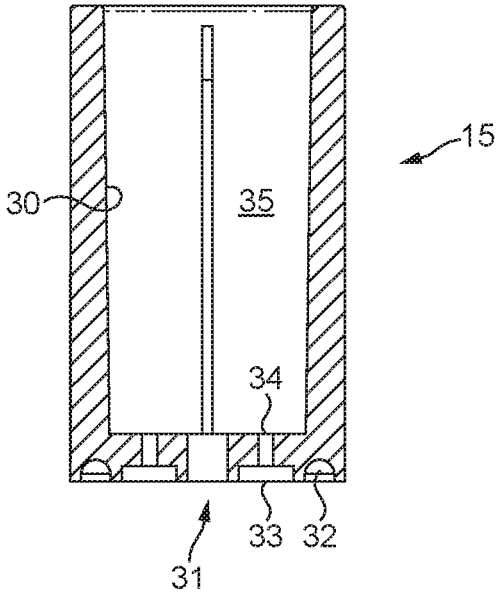

Turning now to FIGS. 6A & 6B, the fixed end wall bracket 15 comprises a hollow spigot, the inner peripheral wall 30 of which engages over the outer wall of the smaller diameter rod section 10*a*. End face 31 of the bracket, as shown in FIG. 6A, is similar to face 23 of the bracket 16 in that it includes a first annulus 32 to locate O-ring 18, and includes a second annulus 33 into which an adhesive may be inserted. Holes 34 project from the annulus 33 into the interior 35 to allow excess adhesive to bleed from the annulus 33 into the interior 35, and a further central hole 36 is provided to enable a screw fixing to is be applied to fix the bracket 15 to a wall.

Figure 5A:
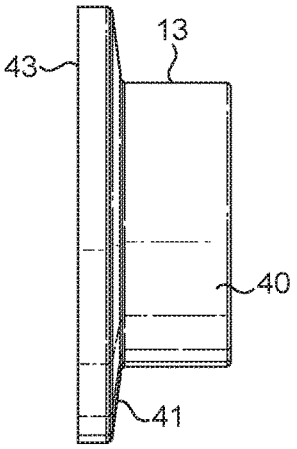
FIGS. 5A to 5C: show various views of a lock ring and end cap shown in FIGS. 1 to 3.
Figure 5B:
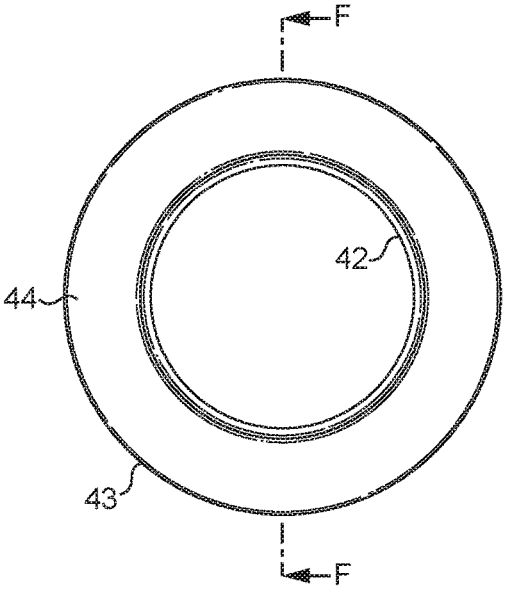
Figure 5C:
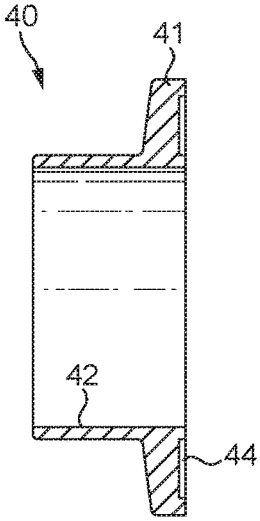

Finally, referring to FIGS. 5A to 5C, the caps 13 are preferably identical and comprise a sleeve section 40 terminating in a mounting flange 41, the inner surface 42 of the sleeve section comprising a sliding fit over the adjustment sleeve 17 and the fixed end wall bracket 15 respectively. The reverse face 43 of the mounting flange 41, being the surface that engages the wall, includes an annulus 44 that serves to locate and retain the ring 19 of double-sided tape.

It will thus be appreciated that the invention provides a relatively simple yet effective form of shower curtain rod assembly, and/or a method of mounting a shower curtain rod, and/or a method and apparatus for supplementing the mounting of a shower curtain rod which is simple to implement yet is highly effective in use.

The invention claimed is:

1. A method of securing a shower rod between facing walls, the method comprising:

providing a shower rod with a first end and a second end, the first end of the shower rod being defined by an end bracket;

connecting the end bracket of the shower rod directly to a first wall;

engaging the second end of the shower rod with a second wall; and connecting a separate additional support directly to the first wall using an adhesive to supplement the connection between the end bracket and the first wall; and connecting another separate additional support directly to the second wall to supplement the connection between the second end of the shower rod and the second wall.

2. The method of claim 1, wherein the adhesive comprises double-sided adhesive tape.

3. A method of enhancing the connection between a shower rod and a pair of facing walls between which the shower rod is mounted the shower rod having two opposing ends, each end of the shower rod directly connecting to one of the facing walls, the method comprising providing separate additional supports to supplement the connection between each end of the shower rod and one of the facing walls; and directly connecting the separate additional supports to the facing walls using an adhesive such that the additional supports supplement the connections between the ends of the shower rod and the facing walls.

4. The method of claim 3, wherein the adhesive comprises a double-sided adhesive tape.

5. A shower rod assembly for mounting between facing walls surfaces, the shower rod assembly comprising:

a rod with two opposing ends, an end bracket on each end of the rod, the end brackets each being directly connected to the respective facing wall; and a pair of separate additional supports, each separate additional support being directly connected to the respective facing wall to supplement the connection between the end brackets on each end of the rod and the facing walls, the separate additional supports comprising caps that cover the junctions between each end of the rod and the facing walls once the shower rod assembly is mounted between the facing walls, the separate additional supports having adhesive surface parts contactable with the facing walls, wherein the separate additional supports surround each of the two opposing ends of the rod.

6. The shower rod assembly of claim 5, wherein the rod is hollow.

7. The shower rod assembly of claim 5, wherein the end brackets are configured to frictionally engage the tcina walls.

8. The shower rod assembly of claim 5, wherein the end brackets are configured to retain an adhesive between the respective end bracket and the facing wall.

9. The shower rod assembly of claim 5, wherein each of the end brackets is provided with an annular groove in a surface thereof facing the wall.

* * * * *